US010093889B2

(12) United States Patent
Fang et al.

(10) Patent No.: US 10,093,889 B2
(45) Date of Patent: Oct. 9, 2018

(54) STABLE LIQUID DETERGENT COMPOSITION CONTAINING A SELF-STRUCTURING SURFACTANT SYSTEM

(71) Applicant: The Procter & Gamble Company, Cincinnati, OH (US)

(72) Inventors: Liangjing Fang, Beijing (CN); Ming Tang, Beijing (CN); Karl Shiqing Wei, Mason, OH (US); Peng Qin, Beijing (CN); Ting He, Beijing (CN)

(73) Assignee: The Procter & Gamble Company, Cincinnati, OH (US)

( * ) Notice: Subject to any disclaimer, the term of this patent is extended or adjusted under 35 U.S.C. 154(b) by 32 days.

(21) Appl. No.: 15/480,402

(22) Filed: Apr. 6, 2017

(65) Prior Publication Data

US 2017/0292096 A1 Oct. 12, 2017

(30) Foreign Application Priority Data

Apr. 6, 2016 (WO) ..... PCT/CN2016/078514

(51) Int. Cl.

| | |
|---|---|
| ***C11D 1/66*** | (2006.01) |
| ***C11D 3/50*** | (2006.01) |
| ***C11D 1/83*** | (2006.01) |
| ***C11D 3/04*** | (2006.01) |
| ***C11D 17/00*** | (2006.01) |
| *C11D 1/22* | (2006.01) |
| *C11D 1/72* | (2006.01) |

(52) U.S. Cl.

CPC ..... *C11D 3/505* (2013.01); *C11D 1/66* (2013.01); *C11D 1/83* (2013.01); *C11D 3/046* (2013.01); *C11D 17/003* (2013.01); *C11D 17/0026* (2013.01); *C11D 17/0039* (2013.01); *C11D 1/22* (2013.01); *C11D 1/72* (2013.01)

(58) Field of Classification Search

None

See application file for complete search history.

(56) References Cited

U.S. PATENT DOCUMENTS

| | | | | |
|---|---|---|---|---|
| 2001/0031716 | A1 | 10/2001 | Grant et al. | |
| 2008/0248987 | A1 | 10/2008 | Seebeck et al. | |
| 2010/0197551 | A1* | 8/2010 | Bettiol | C11D 3/0089 510/236 |
| 2014/0206591 | A1 | 7/2014 | Keuleers et al. | |
| 2015/0275136 | A1 | 10/2015 | Si et al. | |
| 2017/0292085 | A1 | 10/2017 | Fang et al. | |
| 2017/0292097 | A1 | 10/2017 | Fang | |
| 2017/0292098 | A1 | 10/2017 | Fang et al. | |

FOREIGN PATENT DOCUMENTS

WO WO 2015/144053 A1 10/2015

OTHER PUBLICATIONS

PCT Search Report for International application No. PCT/CN2016/078514, dated Jan. 11, 2017, 4 pages.

* cited by examiner

*Primary Examiner* — Necholus Ogden, Jr.
(74) *Attorney, Agent, or Firm* — Andres E. Velarde

(57) ABSTRACT

A self-structuring surfactant system. A stable liquid detergent composition containing the same. A liquid detergent composition that includes a linear alkyl benzene sulfonate and a branched nonionic surfactant that is a branched alkoxylated alkyl alcohol.

12 Claims, 1 Drawing Sheet

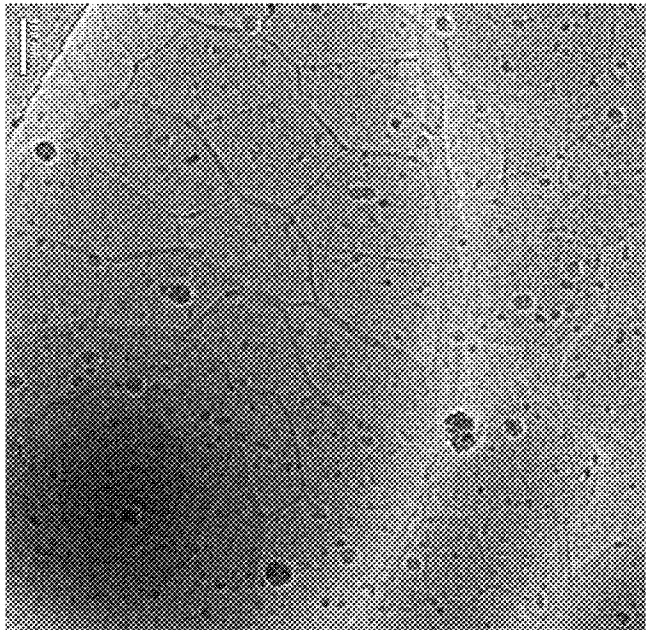

STABLE LIQUID DETERGENT COMPOSITION CONTAINING A SELF-STRUCTURING SURFACTANT SYSTEM

FIELD OF THE INVENTION

The present disclosure relates to a stable liquid detergent composition containing a self-structuring surfactant system. With minimal amount of or even without any external structurants, such a liquid detergent composition exhibits good shear thinning properties while maintaining stability under high shear.

BACKGROUND OF THE INVENTION

Structured heavy duty liquid (HDL) detergent compositions are attracting more and more attention. First, structured HDL detergent compositions typically have higher viscosity than unstructured compositions at room temperature and under ambient pressure. Such higher viscosities are perceived by some consumers as containing more cleaning surfactants, being more concentrated, or of better quality. It is therefore desirable to provide structured HDL compositions to better delight consumers. Further, such structured HDL may suspend water-immiscible materials or water-insoluble particles, such as perfume, silicone fluid, mica, or titanium dioxide particles. Such water-immiscible materials or water-insoluble particles can impart various functional, sensory or aesthetic benefits to the HDL detergent compositions. However, such materials and particles tend to phase separate or precipitate out of the HDL detergent compositions when the compositions are exposed to heat, pressure, or agitation—during transportation or extended storage. HDL detergent compositions that have phase separated or contain visible precipitates are perceived by the consumers as being messy, expired, or of poor quality. It is therefore desirable to provide structured HDL detergent compositions that can suspend water-immiscible materials or water-insoluble particles but without undergoing phase separation or precipitation during transportation or extended storage.

It has been reported to use external structurants in HDL detergent compositions to help form structured phase and suspend water-immiscible or water-insoluble ingredients. One such external structurant is hydrogenated castor oil (HCO), which has a thread-like, crystalline structure. However, a separate premix unit is often needed to enable incorporation of HCO into HDL detergent compositions, resulting in additional capital investment and manufacturing cost. In addition, since the HDL detergent compositions need to be pumped through pipelines under high shear conditions during the manufacturing process, it is desirable that such liquid detergent compositions remain stable (i.e., without undergoing phase separation) at high shear. However, a HDL composition containing HCO is often very sensitive to high shear, e.g., it may phase separate when exposed to high shear inside the manufacturing pipelines, which brings challenges to the manufacturing process design. Another drawback for HDL products containing external structurants such as HCO is that these HDL products usually have a non-homogenous appearance, due to the phase separation of HCO, which may negatively impact the consumer's visual perception of the products and signal to the consumers that the product is of relatively lower quality.

Thus, there is a need for a stable, structured HDL detergent composition that minimized or is free of external structurant that may phase separate under high shear conditions. Preferably, such HDL detergent composition can be readily made by a simple batch-mixing process, without the need for a separate pre-mix unit for incorporating external structurants.

WO2014/113559 discloses a liquid detergent composition comprising from 5% to 20% by weight thereof of a surfactant system, which can function as an internal structurant to form a self-structured phase. Liquid detergent compositions disclosed by this reference are characterized by a pouring viscosity of from 2500 mPa·s to 6000 mPa·s at 20° C. and a ratio of medium shear viscosity to high shear viscosity of from 2 to 1. According to WO2014/113559, it is important that such liquid detergent compositions have relatively consistent viscosities at different shear rates, e.g., the viscosity decrease should not be more than half when the shear rate increases from as low as 0.01 $s^{-1}$ to as high as 10 $s^{-1}$. In other words, the liquid detergent compositions disclosed by WO2014/113559 have little or no shear thinning property, i.e., they could not become visibly "thinner" (i.e., there is no significant decrease in their viscosity) when they are exposed to higher shear rates.

However, for a structured HDL detergent composition, it is also desirable to have good shear-thinning property. On one hand, the HDL detergent composition should have a sufficiently high viscosity at a low shear rate, e.g., when it is placed in a stand-still position or under a slow pouring condition, in order to effectively suspend water-immiscible materials or water-insoluble particles. On the other hand, it is beneficiary for the viscosity of the HDL detergent composition to dramatically decrease when it is exposed to a significantly high shear rate, e.g., when the composition is pumped through manufacturing pipelines under high pressure. In this manner, the liquid detergent composition, which is now of a much lower viscosity and therefore much "thinner," can flow easily through the pipelines during manufacturing, with minimal energy consumption.

Accordingly, there is also a need to provide an improved liquid detergent composition with good shear thinning property, which is characterized by a high viscosity at a lower shear rate and a significantly reduced viscosity at a higher shear rate.

SUMMARY OF THE INVENTION

The present disclosure provides a liquid detergent composition which has a self-structuring surfactant system without using any external structurant. The self-structuring surfactant system of the present disclosure is capable of forming tightly or closely packed lamella structure to suspend water-immiscible materials or water-insoluble particles in the liquid detergent composition. Further, the liquid detergent composition containing such self-structuring surfactant system is phase stable under high shear, and it also exhibits good shear thinning property.

The present disclosure relates to a surfactant system which contains:

a) an anionic surfactant selected from the group consisting of $C_8$-$C_{22}$ linear alkyl benzene sulfonates (LAS), acid form thereof (HLAS), and mixture thereof;

b) a branched nonionic surfactant having formula (I):

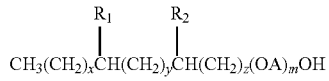

$$CH_3(CH_2)_xCH(R_1)(CH_2)_yCH(R_2)(CH_2)_z(OA)_mOH \quad (I)$$

wherein the total number of carbon atoms in formula (I) is within the range of 10 to 30; $R_1$ and $R_2$ are each independently selected from the group consisting of hydrogen, methyl, ethyl, and propyl, provided that $R_1$ and $R_2$ are not both hydrogen; x is an integer from 0 to 10; y is an integer from 0 to 10; z is an integer from 0 to 10; x+y+z is from 5 to 18; OA is an alkoxy moiety with carbon atoms from 2 to 8; m is an integer from 1 to 5; and wherein the weight ratio of the anionic surfactant to the branched nonionic surfactant is from about 100:1 to about 1:1.

The present disclosure also provides a liquid detergent composition containing the surfactant system described hereinabove. Preferably, the liquid detergent composition of the present disclosure contains: from about 5% to about 50%, preferably from about 6% to about 20%, by total weight of the liquid detergent composition, of said anionic surfactant; and from about 0.05% to about 10%, preferably from about 0.1% to about 5%, and more preferably from about 0.2% to about 3%, by total weight of the liquid detergent composition, of said branched nonionic surfactant.

Preferably, the liquid detergent composition of the present disclosure has a low shear viscosity of from about 3,500 to about 50,000 mPa·s; and a high shear viscosity of no more than about 2,500 mPa·s (e.g. from about 50 to about 2,500 mPa·s). As used herein, the term "low shear viscosity" refers to viscosity measured at a shear rate of 0.5 $s^{-1}$, and the term "high shear viscosity" refers to viscosity measured at a shear rate of 20 $s^{-1}$. Preferably, the ratio of low shear viscosity to high shear viscosity is no less than about 3 (e.g. from about 3 to about 100), more preferably it ranges from about 5 to about 50, and most preferably from about 10 to about 30.

The present disclosure also relates to a method for treating a surface, preferably a fabric, which is in need of treatment, said method comprising the step of contacting said surface with a liquid detergent composition as described hereinabove.

BRIEF DESCRIPTION OF THE DRAWINGS

FIG. 1 is a cryo-TEM photo for a liquid detergent composition according to one embodiment of the present disclosure.

DETAILED DESCRIPTION OF THE INVENTION

Features and benefits of the various embodiments of the present disclosure will become apparent from the following description, which includes examples of specific embodiments intended to give a broad representation of the invention. Various modifications will be apparent to those skilled in the art from this description and from practice of the invention. The scope of the present disclosure is not intended to be limited to the particular forms disclosed and the invention covers all modifications, equivalents, and alternatives falling within the spirit and scope of the invention as defined by the claims.

As used herein, the articles including "the", "a" and "an" when used in a claim or in the specification, are understood to mean one or more of what is claimed or described.

As used herein, the terms "comprise", "comprising", "include", "including", "contain", and "containing" are meant to be non-limiting, i.e., other steps and other ingredients which do not affect the end of result can be added. The above terms encompass the terms "consisting of".

As used herein, the term "substantially free of" or "substantially free from" refers to the presence of no more than 0.5%, preferably no more than 0.2%, and more preferably no more than 0.1%, of an indicated material in a composition, by total weight of such composition.

As used herein, the term "essentially free of" means that the indicated material is not deliberately added to the composition, or preferably not present at analytically detectable levels. It is meant to include compositions whereby the indicated material is present only as an impurity of one of the other materials deliberately added.

As used herein, the term "liquid" refers to a fluid having a liquid having a viscosity of from about 1 to about 2000 mPa·s at 25° C. and a shear rate of 20 $s^{-1}$. In some embodiments, the viscosity of the liquid may be in the range of from about 200 to about 1000 mPa·s at 25° C. at a shear rate of 20 $s^{-1}$. In some embodiments, the viscosity of the liquid may be in the range of from about 200 to about 500 mPa·s at 25° C. at a shear rate of 20 $s^{-1}$. The viscosity is determined using a Brookfield viscometer, No. 2 spindle, at 60 RPM/s.

As used herein, a "water-immiscible" material refers to a material, often liquid, which is incapable of mixing with water to form a homogenous mixture.

As used herein, a "water-insoluble" material refers to a material, often solid, having a solubility of less than about 1 gram per liter (g/L) of deionized water, as measured at 20° C. and under the atmospheric pressure.

As used herein, all concentrations and ratios are on a weight basis unless otherwise specified. All temperatures herein are in degrees Celsius (° C.) unless otherwise indicated. All conditions herein are at 20° C. and under the atmospheric pressure, unless otherwise specifically stated. All polymer molecular weights are by average number molecular weight unless otherwise specifically noted.

An "external structurant" as used herein is a material that has a primary function of providing rheological alteration, typically by increasing viscosity of a fluid, such as a liquid or gel or paste. External structurants that are used in the prior art do not, in and of themselves, provide any significant fabric cleaning or fabric care benefit. An external structurant is thus distinct from an "internal" structurant which, while it can also alter matrix rheology, has been incorporated into the liquid product for a different primary purpose. For example, an internal structurant can be a surfactant that has been added to a liquid detergent composition primarily to act as a cleaning ingredient, but it can at the same time alter rheological properties of such composition. In some cases, such surfactant or surfactant system is capable of creating an internal structured phase, such as worm-like micelle or rod-like micelle, spherical micelle, dispersed lamella and expanded lamella phases, etc., so it is hereby referred to as a "self-structuring" or "self-structured" surfactant system.

It has been a surprising and unexpected discovery that the surfactant system of the present disclosure, when incorporated into a liquid detergent composition, can function as an internal structurant to form lamellar structures, which in turn thicken the liquid detergent composition and help to suspend water-immiscible materials or water-insoluble particles. The liquid detergent composition of the present disclosure further exhibits improved shear thinning property, so that it can easily flow or be pumped through pipelines under pressure during the manufacturing process. Further, it is an advantage that the liquid detergent compositions of the present disclosure do not include any external structurants, such as celluloses, polysaccharide, hydrogenated castor oil (HCO), so that a simple batch-making process is sufficient for forming the needed lamellar structures, without the need for any separate premix unit.

Viscosity

The liquid detergent composition of the present disclosure has a low shear viscosity from about 3,500 to about 50,000 mPa·s, which is measured at a shear rate of 0.5 $s^{-1}$; and a high shear viscosity of no more than about 2,500 mPa·s (e.g. from about 50 to about 2,500 mPa·s), which is measured at a shear rate of 20 $s^{-1}$. The viscosity is determined at 20° C. using an AR-G2 Rheometer (TA Instruments) with a stainless steel cone plate at 2 degree/40 mm diameter and a gap size of 49 μm.

It is important that the liquid detergent composition of the present disclosure has the above-described low shear and high shear viscosities, so that it not only can form a stabilized structure to suspend the water-immiscible materials or water-insoluble particles but also exhibits good shear thinning property for meeting the above-described processing requirement. Specifically, the low shear viscosity of the liquid detergent composition of the present disclosure needs to be about 3,500 mPa·s or more. If the low shear viscosity is below about 3,500 mPa·s, it means that the liquid detergent composition, when placed in a stand-still position or under a low shear pouring condition, is too thin to suspend water-immiscible materials or water-insoluble particles. Meanwhile, the high shear viscosity of the liquid detergent composition of the present disclosure needs to be no more than about 2,500 mPa·s, because if the high shear viscosity is above about 2,500 mPa·s, the liquid detergent composition is too thick to be pumped through pipelines under pressure during the manufacturing process.

Preferably, the liquid detergent composition of the present disclosure has a low shear viscosity from about 4,000 to about 30,000 mPa·s, and more preferably from about 5,000 to about 20,000 mPa·s; and a high shear viscosity from about 100 to about 1,500 mPa·s, and more preferably from about 100 to about 1,000 mPa·s.

Preferably, the liquid detergent composition has a low shear to high shear viscosity ratio of no less than about 3, e.g. from about 3 to about 100, preferably from about 5 to about 50, more preferably from about 10 to about 25.

Surfactants

The self-structuring surfactant system of the present disclosure contains an anionic surfactant and a branched nonionic surfactant. The surfactant system can optionally contain one or more additional surfactants.

Preferably, the weight ratio of the anionic surfactant to the branched nonionic surfactant present in the surfactant system of the present disclosure is from about 100:1 to about 1:1. Preferably, the weight ratio of the anionic surfactant to the branched nonionic surfactant is from about 50:1 to about 1.5:1, more preferably from about 25:1 to about 5:1, and most preferably from about 12:1 to about 5:1. For example, the weight ratio of the anionic surfactant to the branched nonionic surfactant is about 35:1, about 20:1, about 15:1, about 10:1, about 8:1.

Anionic Surfactant

The anionic surfactant as used in the present disclosure can be selected from the group consisting of $C_8$-$C_{22}$ linear alkyl benzene sulfonates (LAS), acid form thereof (HLAS) and mixtures thereof. Typically, LAS surfactants can be readily obtained by sulfonating commercially available linear alkylbenzenes. Exemplary $C_8$-$C_{22}$ LAS that can be used in the present disclosure include alkali metal, alkaline earth metal or ammonium salts of $C_8$-$C_{22}$ linear alkylbenzene sulfonic acids, and preferably the sodium, potassium, magnesium and/or ammonium salts of $C_{10}$-$C_{14}$ linear alkylbenzene sulfonic acids. In one embodiment, the liquid detergent composition contains sodium or potassium salts of $C_{10}$-$C_{14}$ LAS surfactants, or acid form thereof.

The LAS surfactant may be present at a concentration ranging from about 10% to about 99% by weight of the surfactant system. Preferably, the LAS surfactant may be present in the range of from about 20% to about 99% by weight of the surfactant system. More preferably, the anionic surfactant may be present in the range of from about 50% to about 99% by weight of the surfactant system.

Branched Nonionic Surfactant

The surfactant system of the present disclosure further contains a branched nonionic surfactant that is branched alkoxylated alkyl alcohol having formula (I):

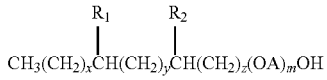

$$CH_3(CH_2)_xCH(R_1)(CH_2)_yCH(R_2)(CH_2)_z(OA)_mOH \quad (I)$$

wherein the total number of carbon atoms in formula (I) is within the range of 10 to 30; $R_1$ and $R_2$ are each independently selected from the group consisting of hydrogen, methyl, ethyl, and propyl, provided that $R_1$ and $R_2$ are not both hydrogen; x is an integer from 0 to 10; y is an integer from 0 to 10; z is an integer from 0 to 10; x+y+z is from 5 to 18; OA is an alkoxy moiety with carbon atoms from 2 to 8; m is an integer from 1 to 5.

US2008/0248987 discloses a liquid detergent composition containing dodecyl benzene sulfonate and branched ethoxylated $C_{13/15}$ alcohol with average degree of ethoxylation of 7~8 at a level of 7%. It has been demonstrated that a liquid detergent composition containing branched ethoxylated alkyl alcohol with such a high degree of ethoxylation has too low of a low shear viscosity that is unable to suspend any water-immiscible materials or water-insoluble particles.

Preferably, the total number of carbon atoms in the branched alkoxylated alkyl alcohol having formula (I) is from 10 to 24; x+y+z is from 4 to 14; OA is an alkoxy moiety selected from the group consisting of ethoxy, propoxy, butoxy, and combination thereof; and m is from 1 to 3.

Preferably, the surfactant system comprises a mixture of branched alkoxylated alkyl alcohols characterized by a weight average total carbon numbers ranging from 10 to 24, and a weight average degree of alkoxylation ranging from 1 to 3.

The branched nonionic surfactant may be present at a concentration ranging from about 1% to about 50% by weight of the surfactant system. Preferably, the branched nonionic surfactant may be present in the range of from about 1% to about 30% by weight of the surfactant system. More preferably, the anionic surfactant may be present in the range of from about 1% to about 20% by weight of the surfactant system.

Additional Surfactants

In addition to surfactants described hereinabove, the liquid detergent compositions of the present disclosure may also contain one or more additional surfactants, as long as such additional surfactants do not interfere with functionalities of the above-described surfactants.

Such additional surfactants may be selected from the group consisting of other anionic surfactants (different from LAS surfactants described hereinabove), zwitterionic surfactants and/or amphoteric surfactants, linear nonionic surfactants, cationic surfactants, and mixtures thereof. Such additional surfactants may be present in the surfactant system in a total amount ranging from about 1% to about 50% by weight of the surfactant system, preferably from about 1 wt % to about 30 wt %.

Other anionic surfactants can be used in the surfactant system of the present disclosure, except alkoxylated alkyl sulfate (AES). Without wishing to be bound by any theory, AES seems to destroy the structured phase or negatively affect the formation thereof. Therefore, it is preferred that the surfactant system of the present disclosure is substantially free of, preferably essentially free of AES. For example, the surfactant system of the present disclosure is substantially free of trideceth sulfate.

Zwitterionic and/or Amphoteric Surfactant

A zwitterionic and/or amphoteric surfactant may be, without limitation, aliphatic secondary or tertiary amine derivatives and containing at least one water-soluble anionic group (for example carboxylate, sulfonate, sulfate, phosphate or phosphonate).

The surfactant system of the present disclosure may further contain one or more zwitterionic and/or amphoteric surfactants selected from the group consisting of amine oxide surfactant and betaine-based surfactant.

The amine oxide surfactant used in the present disclosure may have the formula (III):

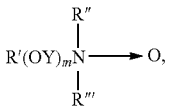

(III)

wherein R' is a $C_{8-22}$ alkyl, a $C_{8-22}$ hydroxyalkyl, or a $C_{8-22}$ alkyl phenyl group; OY is an alkoxy moiety selected from the group consisting of ethoxy, propoxy, butoxy, and combination thereof; m is from 0 to 3; R" and R'" are independently selected from the group consisting of $C_{1-3}$ alkyl group and $C_{1-3}$ hydroxyalkyl group.

Preferably, R' in formula (I) is a $C_{10-18}$ alkyl, OY is an ethoxy or propoxy group, m is 0 to 3, and R" and R'" are independently selected from methyl, ethyl, propyl, isopropyl, 2-hydroethyl, 2-hydroxypropyl or 3-hydroxypropyl. More preferably, the amine oxide surfactant is a $C_{10-18}$ alkyl dimethyl amine oxide or a $C_{8-12}$ alkyl ethoxy dihydroxyethyl amine oxide. In a preferred embodiment, the amine oxide surfactant is a $C_{12-14}$ alkyl dimethyl amine oxide or dodecyl dimethyl amine oxide.

The zwitterionic surfactant used in the present disclosure may be a betaine-based surfactant (carbobetaine, sulfobetaine or phosphobetaine) having formula (IV):

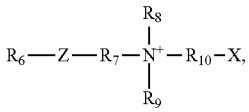

(IV)

wherein $R_6$ is a linear or branched alkyl, cycloalkyl, aryl, aralkyl or alkaryl group containing from 5 to 30 carbon atoms;

Z is a bivalent moiety selected from the group consisting of aminocarbonyl, carbonylamino, carbonyloxy, oxycarbonyloxy, aminocarbonylamino, and combinations and derivatives thereof;

$R_7$ is an alkylene group containing from 1 to 12 carbon atoms;

$R_8$ is an alkyl or hydroxyalkyl group containing from 1 to 10 carbon atoms;

$R_9$ is an alkylene or hydroxyl alkylene group containing from 1 to 5 carbon atoms;

X is selected from the group consisting of carboxylate, sulfonate, phosphonate, acid form thereof, and combinations thereof; and $R_{10}$ is an alkyl or hydroxyalkyl group containing from 1 to 10 carbon atoms.

Preferably, the zwitterionic surfactant used in the present disclosure is a betaine (carbobetaine) or sultaine (sulfobetaine) having formula (III), in which Z is a carbonylamino group; X is carboxylate or sulfonate, or acid form thereof; $R_6$ is a linear or branched alkyl group containing from 5 to 25 carbon atoms; $R_7$ is an alkylene group containing from 1 to 12 carbon atoms; $R_8$ and $R_{10}$ are independently alkyl or hydroxyalkyl groups containing from 1 to 10 carbon atoms; and $R_9$ is an alkylene or hydroxyl alkylene group containing from 1 to 5 carbon atoms.

More preferably, the zwitterionic surfactant used in the present disclosure is a betaine having formula (V),

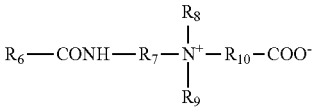

(V)

wherein $R_6$ is a linear alkyl group containing from 8 to 22 carbon atoms; $R_7$ is an alkylene group containing from 2 to 5 carbon atoms, and preferably an ethylene or propylene group; $R_8$ and $R_9$ are independently alkyl groups containing from 1 to 5 carbon atoms, and preferably methyl or ethyl groups; $R_{10}$ is an alkylene group containing from 1 to 3 carbon atoms, and preferably a methylene or ethylene group.

In another embodiment, the zwitterionic surfactant used in the present disclosure is a sultaine having formula (VI),

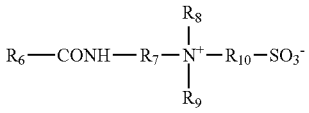

(VI)

wherein $R_6$ is a linear alkyl group containing from 8 to 22 carbon atoms; $R_7$ is an alkylene group containing from 2 to 5 carbon atoms, and preferably an ethylene or propylene group; $R_8$ and $R_{10}$ are independently alkyl groups containing from 1 to 5 carbon atoms, and preferably methyl or ethyl groups; $R_9$ is an alkylene or hydroxyl alkylene group containing from 1 to 3 carbon atoms, and preferably a methylene, ethylene or hydroxypropylene ($CH_2CHOHCH_2$) group.

Examples of suitable zwitterionic surfactant are betaines and sultaines selected from the group consisting of: almondamidopropyl betaine, apricotamidopropyl betaine, avocadamidopropyl betaine, babassuamidopropyl betaine, behenamidopropyl betaine, canolamidopropyl betaine, capryl/capramidopropyl betaine, cocoamidopropyl betaine, coco/oleamidopropyl betaine, coco/sunfloweramidopropyl betaine, cupuassuamidopropyl betaine, isostearamidopropyl betaine, lauramidopropyl betaine, meadowfoamamidopropyl betaine, milkamidopropyl betaine, minkamidopropyl betaine, myristamidopropyl betaine, oatamidopropyl betaine, oleamidopropyl betaine, olivamidopropyl betaine, palmamidopropyl betaine, palmitamidopropyl betaine, palm kernelamidopropyl betaine, ricinoleamidopropyl betaine, sesamidopropyl betaine, shea butteramidopropyl betaine, soyamidopropyl betaine, stearamidopropyl betaine, tallowamidopropyl betaine, undecyleneamidopropyl betaine, wheat germamidopropyl betaine, cocamidopropyl hydroxysultaine (CAPHS), lauramidopropyl hydroxysultaine (LAPHS), oleamidopropyl hydroxysultaine (OAPHS), tallowamidopropyl hydroxysultaine (TAPHS).

Preferably, the zwitterionic surfactant used in the present disclosure is selected from the group consisting of cocoamidopropyl betaine, lauramidopropyl betaine, oleamidopropyl betaine, tallowamidopropyl betaine, and cocamidopropyl hydroxysultaine.

More preferably, the zwitterionic surfactant is cocoamidopropyl betaine or lauramidopropyl betaine.

The zwitterionic and/or amphoteric surfactant may be present in the surfactant system from about 1 wt % to about 50 wt %, preferably from about 1% to about 30%, more preferably from about 5% to about 20% by total weight of the surfactant system of the present disclosure.

Linear Nonionic Surfactants

The surfactant system of the present disclosure may also contain a linear alkyl alkoxylated alcohol. In some embodiments, the linear alkyl alkoxylated alcohol of use includes linear $C_8$-$C_{22}$ alkyl alkoxylated alcohol with a weight average degree of alkoxylation of from about 4 to about 12, preferably from about 6 to about 10. In a specific example, the linear non-ionic surfactant is linear $C_8$-$C_{22}$ alkyl ethoxylated alcohol with an average degree of ethoxylation of from about 4 to about 12, preferably from about 6 to about 10. For example, the linear non-ionic surfactant is linear $C_{10}$-$C_{16}$ alkyl ethoxylated alcohol with an average degree of ethoxylation of from about 6 to about 10.

Optionally, the linear nonionic surfactant is present in the surfactant system from about 1% to about 50%, preferably from about 1% to about 30%, and more preferably from about 10% to about 30% by total weight of the surfactant system of the present disclosure.

Liquid Detergent Composition

As used herein the phrase "detergent composition" or "cleaning composition" includes compositions and formulations designed for cleaning soiled material. Such compositions include but are not limited to, laundry detergent compositions, fabric softening compositions, fabric enhancing compositions, fabric freshening compositions, laundry prewash, laundry pretreat, laundry additives, spray products, dry cleaning agent or composition, laundry rinse additive, wash additive, post-rinse fabric treatment, ironing aid, dish washing compositions, hard surface cleaning compositions, unit dose formulation, delayed delivery formulation, detergent contained on or in a porous substrate or nonwoven sheet, and other suitable forms that may be apparent to one skilled in the art in view of the teachings herein. Such compositions may be used as a pre-cleaning treatment, a post-cleaning treatment, or may be added during the rinse or wash cycle of the cleaning process. The cleaning compositions may have a form selected from liquid, powder, single-phase or multi-phase unit dose or pouch form (e.g., a liquid detergent composition that is contained in a single compartment or multi-compartment water-soluble pouch, e.g., formed by a water-soluble polymer such as poly-vinyl alcohol (PVA) or copolymers thereof), tablet, gel, paste, bar, or flake. In a preferred embodiment of the present disclosure, the detergent composition of the present disclosure is a liquid laundry or dish detergent composition, which is designated for either hand-washing or machine-washing of fabric or dishes.

In another aspect, the liquid detergent composition of the present disclosure contains the surfactant system described hereinabove. Preferably, the liquid detergent composition of the present disclosure contains from about 10% to about 90%, preferably from about 15% to about 60%, by weight of the liquid detergent composition, of the surfactant system described hereinabove.

Preferably, the liquid detergent composition of the present disclosure contains: a) from about 5% to about 50%, preferably from about 6% to about 20%, by weight of the liquid detergent composition, of the anionic surfactant selected from the group consisting of $C_8$-$C_{22}$ linear alkyl benzene sulfonates (LAS), or acid form thereof; and b) from about 0.05% to about 10%, preferably from about 0.1% to about 5%, more preferably from about 0.2% to about 3%, by weight of the liquid detergent composition, of the branched nonionic surfactant described hereinabove.

The LAS anionic surfactant may be present at a concentration ranging from about 5% to about 50% by weight of the liquid detergent composition. If the LAS surfactant is present at too low a concentration, the desired structured phase cannot be formed, and at the same time the cleaning effect is not satisfactory; and if the LAS surfactant is present at too high a concentration, the viscosity of the liquid detergent composition will increase to an exceedingly high extent, resulting in flow difficulty when poured. For example, the LAS surfactant may be present in the range of from about 5% to about 30% by weight of the liquid detergent composition. Preferably, the anionic surfactant may be present in the range of from about 6% to about 20% by weight of the liquid detergent composition.

The branched non-ionic surfactant may be present in the range of from about 0.05% to about 10% by weight of the liquid detergent composition. If the branched non-ionic surfactant is present at too low a concentration, the desired structured phase cannot be formed; and if the concentration of the branched non-ionic surfactant is too high, it may destroy the structured phase or negatively affect the formation thereof. Preferably, the branched non-ionic surfactant may be present in the range of from about 0.1% to about 5% by weight of the liquid detergent composition. More preferably, the branched non-ionic surfactant may be present in the range of from about 0.2% to about 3% by weight of the liquid detergent composition.

Combination of the branched nonionic surfactant and the anionic surfactant provides the liquid detergent composition with a significantly increased low shear viscosity, compared with a similar liquid detergent composition containing the branched nonionic surfactant or the anionic surfactant only. Without wishing to be bound by any theory, it is believed that a structured phase is formed by the interaction of the LAS anionic surfactant and the branched alkoxylated alkyl alcohol co-surfactant. Once there forms a structured phase, viscosity will increase rapidly. Such increased viscosity help to suspend water-immiscible materials or water-insoluble particles in the liquid detergent compositions, such as HDL compositions.

Optionally, the liquid detergent composition of the present disclosure further contains from about 0.1% to about 15%, preferably from about 0.5% to about 10%, more preferably from about 1% to 5%, by weight of the liquid detergent composition, of the one or more additional surfactants described hereinabove. In one embodiment, the liquid detergent composition further contains from about 0.1% to about 10%, preferably from about 1 to about 8%, by weight of the liquid detergent composition, of the amine oxide amphoteric surfactant. In another embodiment, the liquid detergent composition further contains from about 0.1% to about 10%, preferably from about 1 to about 5%, by weight of the liquid detergent composition, of the betaine-based zwitterionic surfactant described hereinabove. In yet another embodiment, the liquid detergent composition further contains from about 0.1% to about 10%, preferably from 1% to 5%, by weight of the liquid detergent composition, of the linear alkoxylated alkyl alcohol described hereinabove.

The liquid detergent composition of the present disclosure is preferably characterized by a pH value ranging from about 3 to about 14, more preferably from about 5 to about 11, and even more preferably from about 6 to about 9.

Preferably, the liquid detergent compositions are provided as homogenous liquid products. The liquid detergent composition may be stable, i.e., with no visible phase separation when placed at 5° C. and under atmospheric pressure for at least 48 hours, preferably no visible phase separation when placed at 25° C. and under atmospheric pressure for at least 48 hours, and more preferably no visible phase separation when placed at 40° C. and under atmospheric pressure for at least 48 hours.

Water-Soluble Metal Salt

The liquid detergent composition may further contain a water-soluble metal salt. The water-soluble metal salt, when present in the liquid detergent composition, is present at a level of from about 0.1% to about 10%, preferably from about 0.2% to about 4%, more preferably from about 0.5% to about 2% by weight of the liquid detergent composition. The water-soluble metal salt may contain a cation selected from alkali metals, alkaline earth metals, ammonium and mixture thereof and an anion selected from chloride, carbonate, bicarbonate, sulfate, phosphate, acetate, nitrate and mixtures thereof. Particularly useful are potassium chloride and sodium chloride.

The water-soluble metal salt is acting as a viscosity modifier in the liquid detergent composition of the present disclosure. A viscosity modifier is a material that is capable of modifying viscosity of a composition to achieve a desired viscosity. The surfactant system in the liquid detergent composition might result in a product with a viscosity that is lower or higher than desired. The viscosity can be increased or decreased by using a viscosity modifier. Without wishing to be bound by any theory, sodium chloride or potassium chloride acts like an ionic strength modifier, through which the transition from lamellar phase to worm-like micelle is driven and the surfactant packing density is adjusted (either denser or looser), so as to keep the existence of structured phase while maintaining stability at the same time.

External Structurant

Preferably, the liquid detergent composition is substantially free of hydrogenated castor oil (HCO). More preferably, the liquid detergent composition is substantially free of crystalline external structurants such as non-polymeric hydroxyl-containing materials, microfibrillated celluloses and non-crystalline external structurants such as polymeric structurants selected from the group consisting of polyacrylates, polysaccharides, polysaccharide derivatives and mixture thereof.

Even more preferably, the liquid detergent composition is substantially free of any external structurants. In a preferred embodiment, the liquid detergent composition is essentially free of any external structurants. External structurants may include microfibrillated celluloses, non-polymeric, hydroxyl-containing materials generally characterized as crystalline, hydroxyl-containing fatty acids, fatty esters and fatty waxes, such as castor oil and castor oil derivatives. It also includes naturally derived and/or synthetic polymeric structurants such as polycarboxylates, polyacrylates, hydrophobically modified ethoxylated urethanes, alkali soluble emulsions, hydrophobically modified alkali soluble emulsions, hydrophobically modified non-ionic polyols, cross-linked polyvinylpyrrolidone, polysaccharide and polysaccharide derivative type. Polysaccharide derivatives typically used as structurants comprise polymeric gum materials. Such gums include pectine, alginate, arabinogalactan (gum Arabic), carrageenan, gellan gum, xanthan gum and guar gum. Other classes of external structurants include structuring clays, amidogellants and fatty esters such as isopropyl myristate, isopropyl palmitate and isopropyl isostearate.

Solvents

The liquid detergent compositions of the present disclosure preferably comprise one or more organic solvents, which may be present in an amount ranging from about 0.01 wt % to about 20 wt %, preferably from about 0.1 wt % to about 10 wt % by total weight of the liquid detergent compositions.

The organic solvents of the present disclosure include, but are not limited to, $C_1$-$C_5$ alkanols such as methanol, ethanol and/or propanol and/or 1-ethoxypentanol; $C_2$-$C_6$ diols, such as ethylene glycol, diethylene glycol, propylene glycol, dipropylene glycol, butylene glycol, pentanediols; $C_3$-$C_8$ alkylene glycols; $C_3$-$C_8$ alkylene glycol mono lower alkyl ethers; glycol dialkyl ether; $C_3$-$C_9$ triols such as glycerol; polyethylene glycols (PEGs) having a weight average molecular weight of about 2000 or less; and mixtures thereof.

The liquid detergent composition preferably contains water in combination with the above-mentioned organic solvent(s) as carrier(s). In some embodiments, water is present in the liquid detergent compositions of the present disclosure in the amount ranging from about 20 wt % to about 90 wt %, preferably from about 25 wt % to about 85 wt %, and more preferably from about 30 wt % to about 80 wt %.

Materials to be Suspended

The liquid detergent composition may further contain one or more benefit materials to be suspended. The benefit material is present in an amount ranging from about 0.01% to about 20% by total weight of the liquid detergent composition. In some embodiments, the benefit material is a water-immiscible material or a water-insoluble particle. Preferably, the water-immiscible material or water-insoluble particle is selected from the group consisting of perfumes, brighteners, dyes, silicone antifoam particles, colorant particles, pearlescent agents such as titanium dioxide and mica, and mixture thereof.

In some embodiments, the benefit material can be present in an encapsulated form. Suitable encapsulates typically comprise a core and a shell encapsulating said core.

The shell material may comprise a material selected from the group consisting of polyvinyl alcohol, polyvinyl acetate, cellulose acetate, poly(vinyl-alcohol-co-vinylacetate), acrylic acid-ethylene-vinyl acetate copolymer and mixtures thereof.

The core may comprise a benefit material selected from the group consisting of perfumes, brighteners, dyes, enzymes, anti-bacterial agents, silicone fluids, bleach activators, bleach boosters, preformed peracid, metal catalyst, diacyl peroxide, hydrogen peroxide source, anti-bacterial agents, and mixtures thereof. In one preferred aspect of said encapsulate, said core may comprise perfume. Such encapsulates are therefore perfume microcapsules. In another preferred aspect of said encapsulate, said core may comprise enzymes, and the resulting encapsulates are then enzyme microcapsules.

The benefit materials to be suspended may have a D50 average particle size ranging from about 0.5 μm to about 200 μm, preferably from about 1 μm to about 150 μm. In some embodiments, the benefit materials may be pearlescent agents having a D50 average particle size of from about 1 μm to about 150 μm, and preferably from 10 μm to about 100 μm. In other embodiments, the benefit materials may be microcapsules having D50 average particle size of from about 1 μm to about 100 μm, preferably from about 5 μm to about 70 μm, and more preferably from about 10 μm to about 50 μm. As used herein, the term D50 average particle size means the value whereby 50% by weight of the particles have a particle size above that value and 50% below.

Adjunct Ingredients

In addition to the above-described ingredients, the liquid detergent compositions of the present disclosure may contain one or more adjunct ingredients. Suitable adjunct ingredients include but are not limited to: builders, chelating agents, dye transfer inhibiting agents, dispersants, enzyme stabilizers, catalytic materials, bleach activators, hydrogen peroxide, polymeric dispersing agents, clay soil removal/anti-redeposition agents, suds suppressors, photobleaches, structure elasticizing agents, fabric softeners, carriers, hydrotropes, processing aids, solvents, hueing agents, antimicrobial agents and/or pigments. The precise nature of these adjunct ingredients and the levels thereof in the laundry liquid detergent composition will depend on the physical form of the composition and the nature of the cleaning operation for which it is to be used.

In a preferred embodiment of the present disclosure, the liquid detergent composition contains from about 0.1 wt % to about 10 wt % of citric acid and/or borax. For example, citric acid may be provided in the amount ranging from about 0.1 wt % to about 5 wt % and borax may be provided in the amount ranging from about 0.1 wt % to about 5 wt %.

Method of Making the Liquid Detergent Compositions of the Present Disclosure

Incorporation of the ingredients as described hereinabove into the liquid detergent compositions of the invention can be done in any suitable manner and can, in general, involve any order of mixing or addition.

For example, one or more of the raw materials as received from the manufacturer can be introduced directly into a preformed mixture of two or more of the other components of the final composition. This can be done at any point in the process of preparing the final composition, including at the very end of the formulating process.

In another example, one or more of the raw materials can be premixed with an emulsifier, a dispersing agent or a suspension agent to form an emulsion, a latex, a dispersion, a suspension, and the like, which is then mixed with other components of the final composition. These components can be added in any order and at any point in the process of preparing the final composition.

Methods of Use

The present disclosure includes methods for cleaning soiled material. As will be appreciated by one skilled in the art, the detergent compositions of the present disclosure are suited for use in laundry pretreatment applications, laundry cleaning applications, and home care applications.

Such methods include, but are not limited to, the steps of contacting detergent compositions in neat form or diluted in wash liquor, with at least a portion of a soiled material and then optionally rinsing the soiled material. The soiled material may be subjected to a washing step prior to the optional rinsing step.

For use in laundry pretreatment applications, the method may include contacting the detergent compositions described herein with soiled fabric. Following pretreatment, the soiled fabric may be laundered in a washing machine or otherwise rinsed.

Test Methods

Test 1: Viscosity Test

Viscosity of the liquid detergent composition of the present disclosure is determined at 20° C. using an AR-G2 Rheometer manufactured by TA Instruments Ltd with a stainless steel cone plate at 2 degree/40 mm diameter and a gap size of 49 μm. The procedure consists of a pre-shear at 10 $s^{-1}$ for 10 seconds and a flow ramp shearing sample at increasing shear rate from 0.1 $s^{-1}$ to 1200 $s^{-1}$. The low shear and high shear viscosity of samples are referring to the data recorded at 0.5 $s^{-1}$ and 20 $s^{-1}$, respectively. The results are reported in units of mPa·s.

Test 2: Cryo-TEM Test

The liquid detergent composition are analyzed via Cyro-TEM techniques according to the following procedure in Institute of Biophysics, Chinese Academy of Sciences: 2 μl of aqueous sample solution is loaded using a micropipette on a lacey carbon film coated Cu TEM grid that is cleaned with plasma cleaner for 30 s to make the carbon film to be negatively charged. The excess fluid on the grid surface is removed by blotting the surface with filter paper with instrument Vitrobot (FEI) to make an aqueous thin film for TEM. The blot force is 6, blot time is 6 seconds and total 3 times blotness. The grid is then plunged into a liquid ethane contained in a small vessel located in a larger liquid nitrogen vessel under −175° C. atmosphere in the cryo-plunge system to vitrify the water film on the grid and to avoid water crystallization. The quenched sample grid is transferred in to the cryo-grid box in the cryo-plunge system. The grid box containing the sample is transferred into a Gatan cryo-transfer system filled with liquid nitrogen and loaded in a cryo-TEM stage, which has been positioned in the cryo-transfer system and cooled down to below −160° C. The sample is loaded in TEM (FEI Tecnai 20) and the images are observed at below −160° C. A much colder finger, cooled to −180° C. in TEM using liquid nitrogen, is present to reduce any possible contamination on the cold specimen surface under high vacuum during TEM analysis. The digital images are taken using a Gatan CCD camera attached at the bottom of the TEM column and Digital Micrograph software.

Test 3: Phase Stability Test

The phase stability of the liquid detergent compositions is evaluated by placing 300 ml of the composition in a 500 ml plastic jar with sealed cap for up to at least 48 hours under atmospheric pressure at 5° C., 25° C. and 40° C., respectively. They are stable to phase separation if, within said time period, (i) they are free from splitting into two or more layers, or (ii) said composition splits into layers, but a major layer comprising at least 90%, preferably 95%, by weight of the composition is present.

EXAMPLES

The following examples describe and demonstrate embodiments within the scope of the invention. The examples are given solely for the purpose of illustration and are not to be construed as limitations of the present disclosure, as many variations thereof are possible without departing from the spirit and scope of the invention.

Example 1: Liquid Detergent Composition

Test samples of the liquid detergent compositions are prepared by adding water into a mixing vessel. Then add some or all of the following ingredients (according to the ingredients listed in the following Tables) while continuously mixing: citric acid solution (50% in water), NaOH solution (50% in water), 1,2-propanediol, boric acid premix, $C_{12}$-$C_{14}$ alkoxylated (EO7) alcohol, branched ethoxylated (EO3) tridecyl alcohol (TDA-3), $C_{10}$-$C_{14}$ LAS, and sodium chloride (10% in water). The first sample is the Comparative Example A containing LAS only, without TDA-3. The second sample is the Inventive Example 1 containing LAS in combination with TDA-3. The pH value of the composition is about 7.6±0.4. Keep mixing until homogeneous.

After preparing these compositions, their low shear viscosity ("LS") at a shear rate of 0.5 $s^{-1}$ and high shear viscosity ("HS") at a shear rate of 20 $s^{-1}$ are determined utilizing the methods disclosed in Test 1 hereinabove. The ratio of the low shear viscosity to the high shear viscosity ("LS/HS") is calculated and the results are gathered below in Table 1.

TABLE 1

| | Liquid detergent composition (wt %) | |
|---|---|---|
| | Comparative Example A | Inventive Example 1 |
| Ingredient | | |
| Citric acid | 2.00 | 2.00 |
| NaOH | 1.45 | 1.45 |
| 1,2-Propanediol | 1.21 | 1.21 |
| Boric acid premix | 2.10 | 2.10 |
| Linear $C_{12}$-$C_{14}$ alkoxylated (EO7) alcohol | 3.25 | 3.25 |
| TDA-3* | 0 | 1.5 |
| LAS** | 10.3 | 10.3 |
| Water | Balance | Balance |
| Measurements | | |
| low shear viscosity (mPa · s, 0.5 $s^{-1}$ @20° C.) | 929 | 13090 |
| high shear viscosity (mPa · s, 20 $s^{-1}$ @20° C.) | 208 | 583 |
| Ratio of LS/HS | 4.47 | 22.45 |

*TDA-3: Branched ethoxylated (EO3) tridecyl alcohol
**LAS: sodium $C_{10}$-$C_{14}$ linear alkyl benzene sulfonate In order to suspend water-immiscible materials or water-insoluble particles, the low shear viscosity of the liquid detergent composition has to be sufficiently high, e.g. from 3,500 mPa·s to 50,000 mPa·s. It can be seen from the results that the low shear viscosity of the Inventive Example 1 containing both LAS and TDA-3 is 13090 mPa·s, sufficiently high for suspending water-immiscible materials or water-insoluble particles. In contrast, the low shear viscosity of the Comparative Example A containing LAS without TDA-3 is only 929 mPa·s, which is too low to suspend any water-immiscible materials or water-insoluble particles. Further, compared to the Comparative Example A, the ratio of the low shear viscosity to the high shear viscosity for the Inventive Example 1 is increased significantly, which shows a desired shear thinning property.

FIG. 1 shows the cryo-TEM photo of the liquid detergent composition of the Inventive Example 1, measured according to the method described in Test 2 hereinabove. It can be seen from FIG. 1 that a structured phase containing a mixture of lamellar and worm-like micelles is present in the structure. This structured phase is effective for suspending water-immiscible materials or water-insoluble particles.

Example 2: Phase Stability Test for Suspending HEPMC or Mica

Example 2 compares phase stability of Inventive Examples 2 and 3 with Comparative Examples B and C, when high efficiency perfume microcapsule (HEPMC) or mica is added as a benefit agent to be suspended thereby, according to the test method described in Test 3 hereinabove. Inventive Examples 2 and 3 contain both LAS and TDA-3, while Comparative Examples B and C contain LAS only (without TDA-3). HEPMC is added to both Inventive Example 2 and Comparative Example B, while mica is added to both Inventive Example 3 and Comparative Example C. The ingredients of the examples and test results are provided as below in Table 2.

TABLE 2

| | Liquid detergent composition (wt %) | | | |
|---|---|---|---|---|
| | Comparative Example B | Inventive Example 2 | Comparative Example C | Inventive Example 3 |
| Ingredient | | | | |
| Citric acid | 2.00 | 2.00 | 2.00 | 2.00 |
| NaOH | 1.45 | 1.45 | 1.45 | 1.45 |
| 1,2-Propanediol | 1.21 | 1.21 | 1.21 | 1.21 |
| Boric acid premix | 2.10 | 2.10 | 2.10 | 2.10 |
| Linear $C_{12}$-$C_{14}$ alkoxylated (EO7) alcohol | 3.25 | 3.25 | 3.25 | 3.25 |
| TDA-3 | 0 | 0.5 | 0 | 0.5 |
| LAS | 10.3 | 10.3 | 10.3 | 10.3 |
| NaCl | 0.6 | 0.6 | 0.6 | 0.6 |
| HEPMC | 0.2 | 0.2 | 0 | 0 |
| Mica | 0 | 0 | 0.04 | 0.04 |
| Water | Balance | Balance | Balance | Balance |
| Stability test (at atmospheric pressure after 48 hr) | | | | |
| 5° C. | Phase Separation | Stable | Phase Separation | Stable |
| 25° C. | Phase Separation | Stable | Phase Separation | Stable |
| 40° C. | Phase Separation | Stable | Phase Separation | Stable |

The phase stability results show that the inventive liquid detergent compositions containing both LAS and TDA-3 can suspend HEPMC or mica while maintaining phase stability at various temperatures such as 5° C., 25° C. or 40° C. for over 48 hours, while the comparative liquid detergent compositions containing only LAS cannot.

Example 3: Comparative Tests of TDA-3 vs. TDA-6

Inventive Example 4 containing TDA-3 and Comparative Example D containing TDA-6 with the same amount are prepared according to the method described in Example 1. The ingredients of the Examples, their low shear viscosity and high shear viscosity as measured, as well as the ratio thereof, are tabulated below in Table 3.

TABLE 3

| | Liquid detergent composition (wt %) | |
|---|---|---|
| | Inventive Example 4 | Comparative Example D |
| Ingredient | | |
| Citric acid | 2.00 | 2.00 |
| NaOH | 1.45 | 1.45 |
| 1,2-Propanediol | 1.21 | 1.21 |
| Boric acid premix | 2.10 | 2.10 |
| Linear $C_{12}$-$C_{14}$ alkoxylated (EO7) alcohol | 3.25 | 3.25 |
| TDA-3 | 0.5 | 0 |
| TDA-6 *** | 0 | 0.5 |
| LAS | 10.3 | 10.3 |
| Water | Balance | Balance |
| Measurements | | |
| Low shear viscosity (mPa · s, 0.5 $s^{-1}$ @20° C.) | 4126 | 2225 |
| High shear viscosity (mPa · s, 20 $s^{-1}$ @20° C.) | 377 | 335 |
| Ratio of LS/HS | 10.94 | 6.64 |

*** TDA-6: branched Ethoxylated (EO6) tridecyl alcohol

As shown by the results in Table 3, the Inventive Examples 4 containing 0.5 wt % of TDA-3 have desired low shear viscosity and high shear viscosity. However, the Comparative Example D containing 0.5 wt % of TDA-6 (having an average number of ethoxylation of 6, which falls outside of the claimed scope), shows a low shear viscosity of 2225 mPa·s, which is too low to capable of suspending water-immiscible materials or water-insoluble particles. Therefore, it is preferred the branched nonionic surfactant has an average number of alkoxylation from 1 to 5.

Example 4: Comparative Tests Showing Impact of NaCl on Viscosity

Table 4 shows Inventive Examples 5 and 6 which have the same compositions as Inventive Examples 4 and 1, except for addition of sodium chloride. The ingredients of these examples, their low shear viscosity and high shear viscosity as measured, as well as the ratio thereof are tabulated below in Table 4.

TABLE 4

| | Liquid detergent composition (wt %) | |
|---|---|---|
| | Inventive Example 5 | Inventive Example 6 |
| Ingredient | | |
| Citric acid | 2.00 | 2.00 |
| NaOH | 1.45 | 1.45 |
| 1,2-Propanediol | 1.21 | 1.21 |
| Boric acid premix | 2.10 | 2.10 |
| Linear $C_{12}$-$C_{14}$ alkoxylated (EO7) alcohol | 3.25 | 3.25 |
| TDA-3 | 0.5 | 1.5 |
| LAS | 10.3 | 10.3 |
| NaCl | 0.6 | 0.6 |
| Water | Balance | Balance |
| Measurements | | |
| Low shear viscosity (mPa · s, 0.5 $s^{-1}$ @20° C.) | 6070 | 4282 |
| High shear viscosity (mPa · s, 20 $s^{-1}$ @20° C.) | 415 | 283 |
| Ratio of LS/HS | 14.65 | 15.13 |

When comparing Inventive Example 4 with Inventive Example 5, it can be seen that the low and high shear viscosities of Inventive Example 5 which further contains NaCl are both higher than those of Inventive Example 4, i.e., addition of NaCl increase the low and high shear viscosities of the liquid detergent composition when TDA-3 is provided at a lower concentration. While comparing Inventive Example 1 with Inventive Example 6, however, the low and high hear viscosities of Inventive Example 6 which further contains NaCl are both lower than those of Inventive Example 1, i.e., addition of NaCl decrease the low and high shear viscosities of the liquid detergent composition when TDA-3 is provided at a higher concentration. This illustrates that sodium chloride may function as a viscosity modifier in a liquid detergent composition to provide a stable phase structure with optimized low and high shear viscosities.

Example 5: Formulations for Heavy Duty Liquid (HDL) Laundry Detergent Compositions The compositional breakdowns of exemplary HDL detergent compositions as specified hereinabove are provided as follows:

TABLE 5

| Ingredient | 5A (wt %) | 5B (wt %) | 5C (wt %) | 5D (wt %) |
|---|---|---|---|---|
| TDA-3 | 0-3 | 1 | 0.5 | 1.5 |
| LAS | 6-20 | 15 | 12 | 12 |
| polyethylene glycol (PEG) | 0-1.5 | 0 | 0 | 0.5 |
| $C_{12-14}$ alkoxylated (EO7) alcohol | 0-5 | 3 | 3 | 3 |
| $C_{12-14}$ dimethyl Amine Oxide | 0-5 | 0.5 | 0 | 0.6 |
| Sodium Chloride | 0-2 | 0.5 | 0.6 | 0.6 |
| Monoethanolamine (MEA) | 0-3 | 0 | 0 | 2.0 |
| Chelant | 0-0.5 | 0.4 | 0.5 | 0.5 |
| Citric Acid | 1-5 | 2 | 2 | 2 |
| $C_{12-18}$ Fatty Acid | 0-3 | 1 | 3 | 1 |
| Borax | 1-5 | 2 | 2 | 2 |
| Ethanol | 0-2 | 0 | 1 | 1.5 |
| Sulfated ethoxylated hexamethylenediamine | 0-1 | 0.5 | 0.6 | 0 |
| Ethoxylated Polyalkyleneimine | 0-5 | 0 | 0 | 2.8 |
| 1,2-Propanediol | 0-3 | 2 | 0 | 1.2 |
| Cumene sulphonate | 0-1.5 | 1.2 | 0.5 | 0.2 |
| Fluorescent Brightener | 0-0.2 | 0.05 | 0.1 | 0.2 |
| enzymes | 0-2.5 | 0.4 | 0.6 | 1.6 |
| Perfume Microcapsule | 0-0.5 | 0.2 | 0.2 | 0.2 |
| Perfume | 0-1 | 0.6 | 0.8 | 0.6 |
| Water, dyes and minors | | Balance | | |

Example 6: Formulations for Dishwashing Liquid Detergent Compositions

The compositional breakdowns of exemplary dishwashing liquid detergent compositions as specified hereinabove are provided as follows:

TABLE 6

| Ingredient | 6A (wt %) | 6B (wt %) | 6C (wt %) | 6D (wt %) |
|---|---|---|---|---|
| TDA-3 | 0-3 | 2 | 0.5 | 1.5 |
| LAS | 6-30 | 15 | 24 | 22 |
| Alkyl $C_{10-16}$ $Ethoxy_{0.2-4}$ | 0-5 | 0 | 0 | 2 |

TABLE 6-continued

| Ingredient | 6A (wt %) | 6B (wt %) | 6C (wt %) | 6D (wt %) |
|---|---|---|---|---|
| Sulfate | | | | |
| C12-14 dimethyl Amine Oxide | 0-5 | 2 | 0 | 0.5 |
| Linear C12-C14 alkoxylated (EO7) alcohol | 0-5 | 2.5 | 3 | 3 |
| Sodium Chloride | 0-2 | 0.5 | 0.8 | 0.6 |
| Polypropylene glycol (MW 2000) | 0-2 | 1.1 | 0.8 | 1.1 |
| Alkoxylated Polyalkyleneimine | 0-2 | 0 | 2.4 | 3.1 |
| Chelant | 0-0.5 | 0.2 | 0.5 | 0.5 |
| Borax | 1-5 | 2 | 2 | 2 |
| enzymes | 0-2.5 | 0.4 | 0.6 | 1.6 |
| Ethanol | 0-5 | 4 | 5 | 3 |
| Water, dyes and minors | | | Balance | |

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present disclosure have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A surfactant system, comprising:

a) 5-50% by weight of an anionic surfactant selected from the group consisting of $C_{10}$-$C_{14}$ linear alkyl benzene sulfonates, acid form thereof, and mixtures thereof; and b) 0.05 to 10% by weight a branched nonionic surfactant that is a branched alkyl alkoxylated alcohol having formula (I):

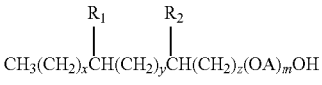

$$CH_3(CH_2)_x\overset{R_1}{\overset{|}{C}}H(CH_2)_y\overset{R_2}{\overset{|}{C}}H(CH_2)_z(OA)_mOH \quad (I)$$

wherein the total number of carbon atoms in formula (I) is within the range of 10 to 24; $R_1$ and $R_2$ are each independently selected from the group consisting of hydrogen, methyl, ethyl, and propyl, provided that $R_1$ and $R_2$ are not both hydrogen; x is an integer from 0 to 10; y is an integer from 0 to 10; z is an integer from 0 to 10; x+y+z is from 4 to 14; OA is an alkoxy moiety selected from the group consisting of ethoxy, propoxy, butoxy, and combination thereof; and m is an integer from 1 to 3; and (c) 0-10% by weight of a linear nonionic surfactant;

wherein the weight ratio of the anionic surfactant to the branched nonionic surfactant is from 100:1 to 1:1 and wherein said liquid detergent composition exhibits no phase separation after being placed at 5° C. for 48 hours said composition having a first viscosity ranging from 3,500 to 50,000 mPa·s, as measured at a first shear rate of 0.5 $s^{-1}$, and a second viscosity of no more than 2,500 mPa·s, as measured at a second shear rate of 20 $s^{-1}$.

2. The surfactant system according to claim 1, wherein the weight ratio of the anionic surfactant to the branched nonionic surfactant is from 50:1 to 1.5:1.

3. The surfactant system according to claim 1, wherein the weight ratio of the anionic surfactant to the branched nonionic surfactant is preferably from 25:1 to 5:1.

4. The surfactant system according to claim 1, comprising a mixture of branched alkyl alkoxylated alcohols characterized by a weight average total carbon number ranging from 10 to 24, and a weight average degree of alkoxylation ranging from 1 to 3.

5. The surfactant system according to claim 1, further comprising a linear $C_8$-$C_{22}$ alkyl ethoxylated alcohol with a weight average degree of ethoxylation ranging from 4 to 12.

6. The surfactant system according to claim 1, wherein the surfactant system is substantially free of trideceth sulfate, and the surfactant system is substantially free of alkoxylated alkyl sulfate (AES), wherein the term "substantially free of" refers to the presence of no more than 0.5% of an indicated material in a composition, by total weight of such composition.

7. The liquid detergent composition according to claim 1, further comprising a water-soluble metal salt having a cation selected from the group consisting of alkali metals, alkaline earth metals, ammonium and mixtures thereof and an anion selected from the group consisting of chloride, carbonate, bicarbonate, sulfate, phosphate, acetate, nitrate and mixtures thereof, wherein the water-soluble metal salt is present at a level of from 0.1% to 10%, by weight of the liquid detergent composition.

8. The liquid detergent composition according to claim 1, wherein the ratio of the first viscosity to the second viscosity is no less than 3.

9. The liquid detergent composition according to claim 1, wherein the liquid detergent composition is substantially free of any external structurant, wherein the term "substantially free of" refers to the presence of no more than 0.5% of an indicated material in a composition, by total weight of such composition.

10. The liquid detergent composition according to claim 1, further comprising from 0.01% to 20% of one or more benefit materials comprising water-immiscible materials or water-insoluble particles.

11. The liquid detergent composition according to claim 1, wherein the one or more benefit materials are perfume microcapsules or enzyme microcapsules.

12. A method for treating a surface, which is in need of treatment, said method comprising the step of contacting said surface with the liquid detergent composition according to claim 1.

* * * * *